US005109620A

United States Patent [19]

Torrence

[11] Patent Number: 5,109,620

[45] Date of Patent: May 5, 1992

[54] FLOWING LIQUID ILLUSION

[75] Inventor: Arthur L. Torrence, Newtown, Conn.

[73] Assignee: Mechtronics Corporation, Stamford, Conn.

[21] Appl. No.: 746,736

[22] Filed: Aug. 19, 1991

[51] Int. Cl.[5] ..... G09F 19/00

[52] U.S. Cl. ..... 40/406; 40/409

[58] Field of Search ..... 40/406, 409; 261/DIG. 71

[56] References Cited

U.S. PATENT DOCUMENTS

| | | | |
|---|---|---|---|
| 1,536,188 | 5/1925 | Brown | 40/406 |
| 1,712,487 | 5/1929 | Avirgon | 40/406 |
| 1,990,230 | 2/1935 | Gray | 40/406 |
| 2,762,202 | 9/1956 | Ponsar | 261/DIG. 75 X |
| 3,371,618 | 3/1968 | Chambers | 261/DIG. 75 X |
| 3,938,738 | 2/1976 | Nagel et al. | 261/DIG. 75 X |
| 4,162,970 | 7/1979 | Zlokarnik | 261/DIG. 75 X |
| 4,586,280 | 5/1986 | Dane | 40/406 X |

*Primary Examiner*—Kenneth J. Dorner
*Assistant Examiner*—Cassandra Hope
*Attorney, Agent, or Firm*—Haynes N. Johnson

[57] ABSTRACT

A display providing the illusion of a stream of liquid coming from an unconnected spigot, the stream flowing into a receptacle. A transparent tube, hidden within the stream, runs from the receptacle to the spigot to carry the liquid upwardly to the spigot. A second tube, colorless and transparent, surrounds the stream of water, to prevent evaporation and accidental spillage on a person. A small colorless and transparent air tube runs from the receptacle upwardly between the inner and outer tubes to a mixing chamber at the top of the tubes. Air is drawn upwardly through the tube by a Venturi effect within the mixing chamber and mixes with the water. As a result, the downwardly flowing water is filled with bubbles and can be seen.

14 Claims, 2 Drawing Sheets

FLOWING LIQUID ILLUSION

FIELD OF THE INVENTION

This invention relates to the field of displays which present optical illusions. In particular, it relates to a display in which liquid appears to flow continually from an unattached spigot into a receptacle which doesn't fill. This liquid could appear to be water, or could be colored to represent some other liquid such as cola or beer.

BACKGROUND OF THE INVENTION

Displays of this general type are old. They have been made by having a colorless transparent tube, to carry the liquid upwardly, hidden within the stream of downflowing water. The water appears to flow from a free-standing unattached spigot to a receptacle resting on a base. A pump is hidden in the base to pump the liquid up through the tube to the spigot.

Displays of this type have two disadvantages: the liquid, being exposed to the air, evaporates, and, so, the unit has to be periodically refilled; and persons can accidentally bump into it, getting themselves or their clothes wet.

My invention obviates these problems by having an outer, transparent tube surrounding the downward flow of liquid and surrounding the tube carrying water upwardly.

BRIEF SUMMARY OF THE INVENTION

This invention is a display which provides the illusion of a stream of liquid coming from an unconnected spigot. The stream flows into a receptacle below which is mounted on a base. A transparent tube, hidden within the stream, runs from the base to the spigot to carry the liquid upwardly to the spigot. A pump within the base pumps the water from the receptacle up the tube to the spigot.

In my device there is a second tube, colorless and transparent, surrounding the stream of water, to obviate the above-mentioned problems of evaporation and accidental spillage on a person. This improvement, however, creates another problem: it is hard to see the motion of liquid when it is flowing through a tube, since the flow is quite steady and uniform. Accordingly, I have found that this can be cured by foaming the water with air to create a stream of bubbles.

A small colorless and transparent air tube runs from the receptacle upwardly between the inner and outer tubes to a mixing chamber at the top of the,, tubes. Air is drawn upwardly through the tube by a Venturi like effect within the mixing chamber and mixes with the water. As a result, the downwardly flowing water is filled with bubbles and can be seen.

Preferably, the entire system is closed, to prevent evaporation or escape of air.

DETAILED DESCRIPTION OF THE INVENTION

Figure 1:
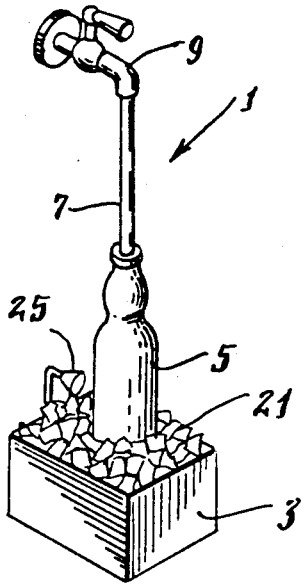
FIG. 1 is a perspective view of one type of my device, in this instance a spigot pouring "beer" into a beer bottle.

My display is an illusion which makes it appear that liquid is continuously flowing from an unattached spigot into a vessel which never fills up. As seen in FIG. 1, the display 1 includes a base 3 having a receptacle 5 on it. By way of an example, a beer bottle is shown with a transparent outer tube 7 running from the mouth of the bottle vertically to an unattached spigot 9. In use, a bubbly air and water mix 12 is seen flowing down tube 7. If desired, the water can be colored to look like beer or some other beverage such as cola.

The top 29 of bottle 5 is sealed around outer tube 7 so that the joint is substantially air and water tight. This prevents or reduces evaporation of the water.

To enhance the illusion, base 3 can carry cubes 21 of imitation ice. The ice and the bottle are illuminated by lamps 21 and 25.

Figure 2:
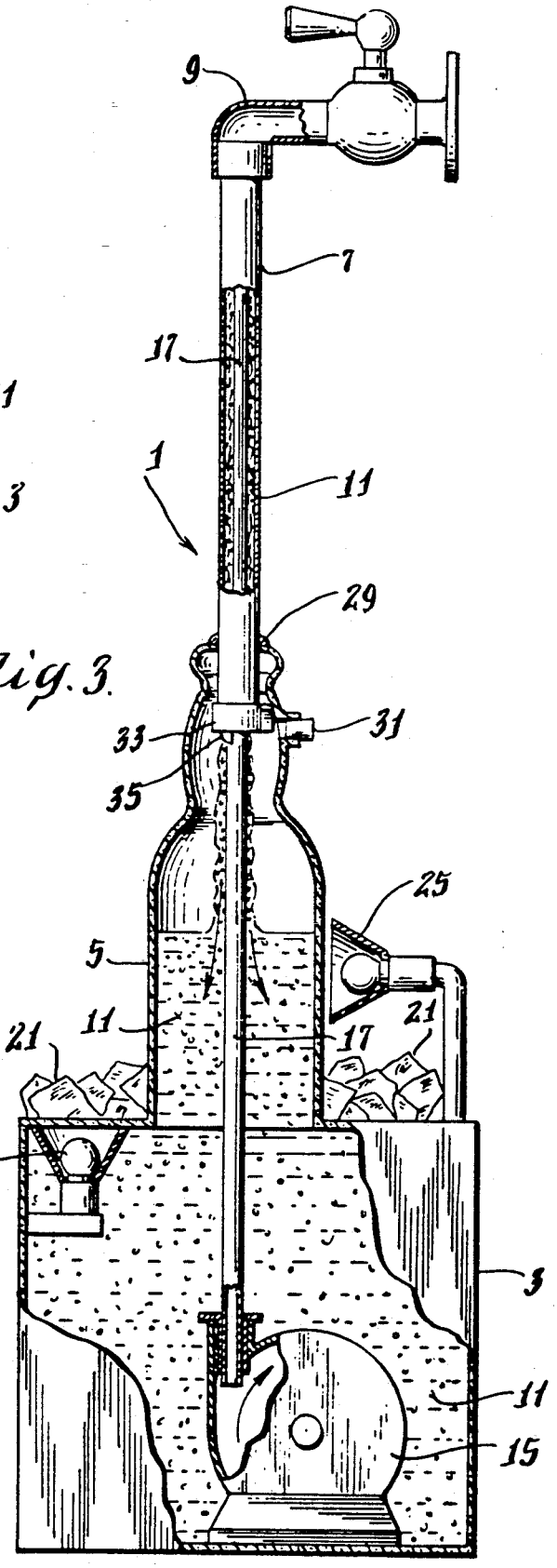
FIG. 2 is a side elevation, partially in section, showing the inside of the base and the bottle.
Figure 3:
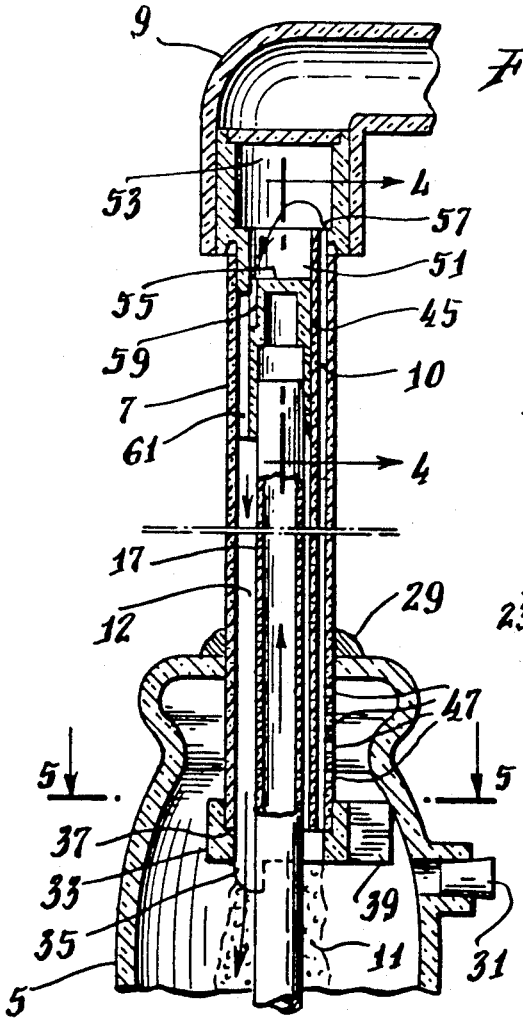
FIG. 3 is a vertical section showing the passages for, and flow of, the water and air.
Figure 7:
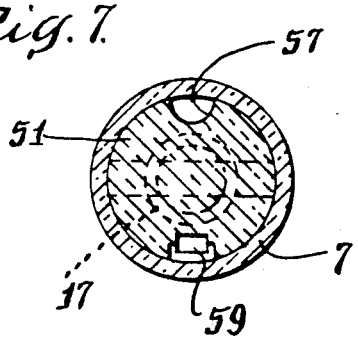
FIG. 7 is a section, taken on line 7—7 of FIG. 4, showing the mixing chamber.
Figure 8:
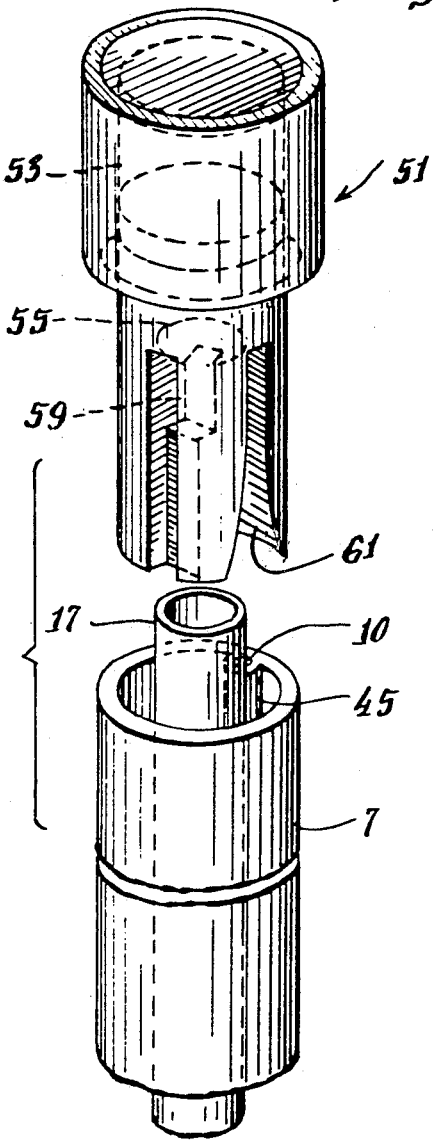
FIG. 8 is an exploded view showing details of the mixing chamber.
Figure 4:
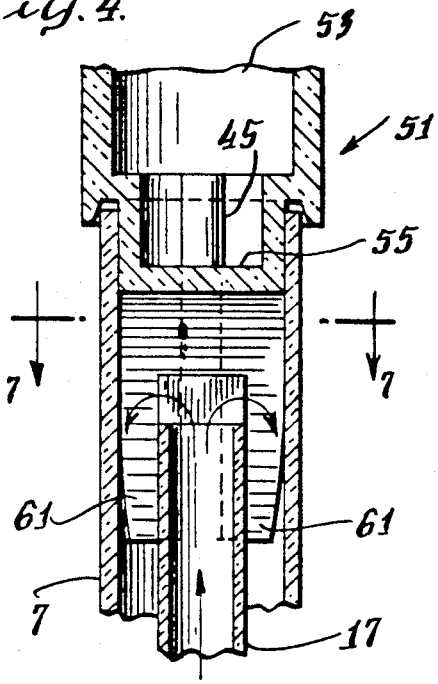
FIG. 4 is a vertical section through the mixing chamber.
Figure 5:
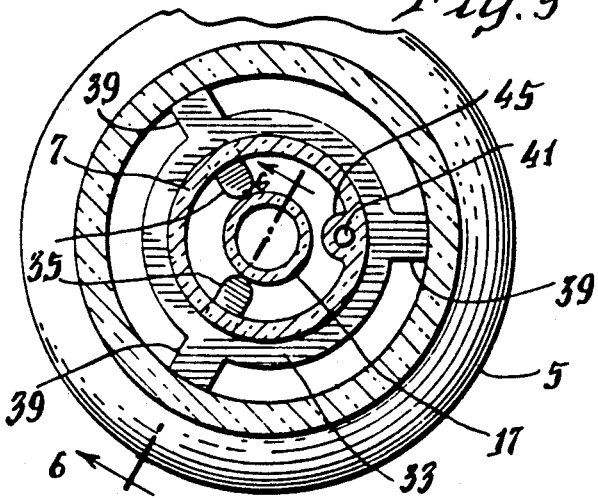
FIG. 5 is a horizontal section, taken on line 5—5 of FIG. 3, showing the centering bushing which holds the various tubes used in my device.

A water tube 17 is positioned concentrically inside tube 7 (FIGS. 2 and 3). This tube is to carry water 11 upward to the spigot end of tube 7. The water, which collects in bottomless bottle 5 interconnected with base 3, is forced upwardly by pump 15. The water flows downwardly to the bottle in the space between outer tube 7 and inner water tube 17. Water tube 17 may be colored the color that is desired for the liquid, so that the downwardly flowing water appears to be the color of the tube. Alternatively, dye can be added to the water.

It is difficult to see the flow of water within a tube. To overcome this problem, I aerate the water to give it a bubbly appearance. To do this a transparent, colorless air tube 45 runs from the neck of bottle 5 upwardly between outer tube 7 and inner water tube 17 to the spigot area. Tube 45 is best hidden if it is located on the rearward side of the display.

Figure 6:
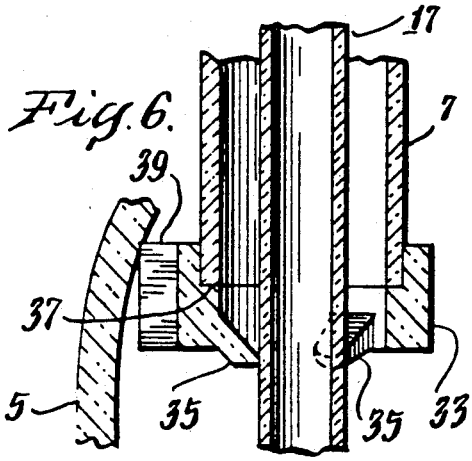
FIG. 6 is a section taken on line 6'6 of FIG. 5.

Outer tube 7 and air tube 45 are supported by tube centering bushing 33, positioned in the neck of the bottle. (Water tube 17 continues down and is supported by pump 15). Bushing 33 includes centering pins for water tube 17, a base for outer tube 7, a supporting pin for air tube 45, and spacers 39 to center the bushing itself (FIGS. 3 and 6).

Air 10, from within the bottle, enters tube 45 through holes 47 in the tube, and is drawn upwardly by Venturi like action to mixing chamber 51, located at the top of tubes 7, 17, and 45 and just inside the outlet of spigot 9. The water and air are mixed in mixing chamber 51, producing a frothy mixture which then goes down to the bottle in the space between outer tube 7 and inner water tube 17.

Mixing chamber 51 fits within the end of the spigot and the upper end of outer tube 7. It has an air-receiving well 53 with a base 55. Air from air tube 45 enters well 53 through air inlet opening 57. It leaves the well through air outlet opening 59, the latter connecting through slot 60 to the space between tubes 7 and 17.

Water, forced upwardly through inner water tube 17 by pump 15, passes through water return,, openings into outer tube 7. In so doing, it creates a Venturi like suction which pulls air upwardly through air tube 45, into air-receiving well 53, and out air outlet 59 and slot 60. The air mixes with the water and creates the bubbly, frothy effect, and thus permits the water to be seen more readily as it flows down between outer tube 7 and inner tube 17. This water flow conceals inner tube 17 from view and so helps to create the illusion.

It should be noted that this display is a closed system. The water which forms the stream from the spigot goes into base 3 and is pumped back upward to be reused. The air which comes down with the water goes into the bottle and is sucked up tube 45 for reuse. Bottle 5 has an inconspicuous corked opening 31 in the back of the neck, permitting initial filling and change of liquids.

When the display is in operation, one sees a stream of bubbly liquid apparently flowing from the unattached spigot 9 down the outer tube 5 into a bottle or other receptacle 5, which appears never to fill up. The rising water tube 17 is concealed within the water stream and so is not seen.

As can be seen, this display overcomes the problems of earlier displays in that evaporation is eliminated or greatly reduced, and persons cannot accidentally bump into the water stream and get themselves or their clothes wet.

I claim:

1. A display for creating the illusion of liquid streaming from an unattached source, said display including a base supporting a receptacle, said base and said receptacle being interconnected and capable of holding said liquid, a spigot positioned above said receptacle, a transparent outer tube leading from said spigot to said receptacle and supporting said spigot, a second tube within said outer tube, said second tube running from said base to said spigot, means for forcing said liquid from said base up said second tube, and means interconnecting the upper ends of said outer tube and said second tube, whereby said liquid pass upwardly through said second tube and downwardly to said receptacle between said second and outer tube said outer tube.

2. A display as set forth in claim 1 in which said interconnecting means is a mixing chamber, and including means for mixing air with said liquid in said mixing chamber.

3. A display as set forth in claim 1 including an air tube between said outer tube and said second tube and means for interconnecting said air tube with said outer tube.

4. A display as set forth in claim 3 in which the lower end of said air tube is in said receptacle and including air openings in said air tube whereby air may enter said tube.

5. A display as set forth in claim 1 in which said outer tube is colorless and said second tube is colored thereby imparting color to said liquid flowing down said outer tube.

6. A display to produce the illusion of liquid continuously flowing from an unattached source, said display including a receptacle and a spigot, a pair of substantially vertical concentric tubes running from said spigot to said receptacle, said tubes being interconnected at their upper ends, the outer one of said tubes being transparent, means associated with said receptacle for forcing liquid up the inner of said tubes whereby the liquid can flow downwardly between said tubes, and means for supplying air to the liquid, whereby, when flowing downwardly between said pair of concentric tubes, liquid will have a bubbly appearance.

7. A display as set forth in claim 6 in which said means for supplying air supplies said air at the point of interconnection of said tubes.

8. A display as set forth in claim 6 in which said means for supplying air is a third tube, positioned between said concentric tubes.

9. A display as set forth in claim 6 including a mixing chamber at the point of intersection of said tubes and in which said means for supplying air supplies it in said mixing chamber.

10. A display as set forth in claim 6 in which said display is a closed system.

11. A display to produce the illusion of liquid continuously flowing from an unattached source, said display including a base, a receptacle carried by said base, said base and said receptacle being interconnected whereby said base and said receptacle are a common vessel for holding liquid, a pump within said base, a pair of tubes for carrying liquid, one within the other, mounted within said receptacle, the inner of said tubes being connected to said pump, and the lower end of said outer tube being in said receptacle, the tubes of said pair being coterminus at their upper end, an air tube positioned within said outer tube and running from within said receptacle to the upper end of said pair of tubes, a mixing chamber mounted at the upper end of said pair of tubes and said air tube to receive liquid carried by the inner of said pair of tubes and air carried by said air tube and to mix the air with the liquid and direct the mixture of air and liquid downwardly between said pair of tubes, and a spigot having its outlet secured to said mixing chamber.

12. A display as set forth in claim 11 in which said pair of tubes are concentric and said air tube is between the inner and outer of said pair of tubes.

13. A display as set forth in claim 11 which is a closed system preventing air and water from leaving said display.

14. A display as set forth in claim 11 in which the outer of said pair of tubes is transparent and colorless and the inner of said pair of tubes is colored, whereby water passing between said pair of tubes will appear colored.

* * * * *